US006684872B2

(12) United States Patent
Kao et al.

(10) Patent No.: US 6,684,872 B2
(45) Date of Patent: Feb. 3, 2004

(54) FIXED CONTACT POINT PRACTICING MACHINE

(76) Inventors: Chien-Wen Kao, PO Box 82-144, Taipei (TW); Yao-Hui Tang, PO Box 82-144, Taipei (TW)

( * ) Notice: Subject to any disclaimer, the term of this patent is extended or adjusted under 35 U.S.C. 154(b) by 0 days.

(21) Appl. No.: 10/159,029

(22) Filed: Jun. 3, 2002

(65) Prior Publication Data

US 2003/0221683 A1 Dec. 4, 2003

(51) Int. Cl.[7] ..... F41B 11/00
(52) U.S. Cl. ..... 124/61; 124/56
(58) Field of Search ..... 124/61, 73, 70, 124/71, 59, 56

(56) References Cited

U.S. PATENT DOCUMENTS 4,091,791 A * 5/1978 Castelli et al. ..... 124/73
5,160,131 A * 11/1992 Leon ..... 473/451
5,221,081 A * 6/1993 Rooks ..... 124/16
5,294,109 A * 3/1994 Meade ..... 124/54
5,337,726 A * 8/1994 Wood ..... 124/61
5,597,160 A * 1/1997 Mims ..... 124/16
5,733,209 A * 3/1998 McIntyre, IV ..... 473/436
5,746,670 A * 5/1998 Brady ..... 473/451
6,167,878 B1 * 1/2001 Nickerson et al. ..... 124/64
2003/0069092 A1 * 4/2003 Gowan et al. ..... 473/416

* cited by examiner

*Primary Examiner*—Charles T. Jordan
*Assistant Examiner*—John W. Zerr
(74) *Attorney, Agent, or Firm*—Leong C. Lei

(57) ABSTRACT

A fixed point contact practicing machine which includes a vertically popping device being disposed on a base of the practicing machine, a penetrating hole being disposed on the lateral side of the hole on the top of a loading stand of the popping device, and a penetrating hole being disposed at the bottom of a suspending stand, whereby the base ball is accommodated in an accomodating chamber when the contractible axle of the pressure cylinder pushing out, thereby pushing the compressed spring to shoot out the baseball from the top in order to provide practice or baseball batters.

1 Claim, 9 Drawing Sheets

FIXED CONTACT POINT PRACTICING MACHINE

BACKGROUND OF THE INVENTION 1. (a) Field of the Invention

The present invention is related to a fixed contact point practicing machine, and more particularly, to a practicing machine for baseball batting.

2. (b) Description of the Prior Art

The structure of traditional baseball and software throwing ball machines is shown in FIGS. 1 to 3. The structure of these machines comprises a base (1A); a board (1B) vertical to the ground being installed on the base (1A), and the board (1B) having a penetrating groove hole (11) vertical to the ground; a sliding base (12) being disposed on the groove hole (11) such that the sliding base (12) can slide up and down along the groove hole (11); a motor (3) being set on the board (1B) on the left side of the sliding base (12), and the motor (13) being coupled to the axle of a transmission box (13A) and the sliding base (12) such that the motor (13) drives the sliding base along the groove hole (11) for the adjustment; a sliding track (14A) and a sliding member (15) being disposed at the lower left end of the sliding base (12) and a rotary member (15) having spring (16A, 16B) on the side wall of the sliding member (14B), and a motor (17) being set at an end of the sliding track (14A) and the motor (17) being coupled to the rotary axle (17B) of a transmission box the motor (17) such that the motor (17) drives the sliding member (14B) along the sliding track (14A) for the back and forth adjustment; and the driving mechanism is by a motor (2) on the upper left side of the board (1B), and the rotary axle extending to a chained wheel (21) and gear (22) on the right side of the board (1B), and unidirectional bearings at different direction being disposed between the chained wheel (21), gear (22) and the axle of the motor (2), and a chain (23) of the chain wheel (21) being linked to another chain wheel (24) which extends an axle to the left side of the board (1B), and a gear (25) being disposed at the end of the axle; as to baseball throwing mechanism is by the throwing arm (3) on the left side of the board (1B), and the throwing arm (3) has a an accommodating groove plate (31) at its front end, and a braking disk (32) at the other end that extends an axle to the right side of the board (1B), and a big gear (33) at the end of the axle corresponsive to the driving mechanism of the gear (22), and a rotary member (34) is disposed at the side wall of the big gear (33), and the rotary member (34) being coupled to the other ends of the springs (16A, 16B) on the sliding member (14B). Softball throwing mechanism is by the throwing arm (4) on the left side of the board (1B), and the throwing arm (4) has an accommodating groove plate (41) at its front end, and a braking disk (42) at the other end that extends an axle to the left side of the board (1B), and a big gear (43) at the end of the axle corresponsive to the driving mechanism of the gear (25), and a rotary member (44) is disposed at the side wall of the big gear (43), and the rotary member (44) being coupled to the springs (45A, 45B), and the other end of the springs (45A, 45B) being inclined on the base (1A); by means of the foregoing structure, the movement of the baseball throwing mechanism or softball throwing mechanism can be controlled by the clockwise and anticlockwise rotation of the driving device of the motor (2). However, such structure and its manufacturing process are very complicated and the cost is very high, and furthermore, it may cause failure easily. There is a need for the manufacturing industry to make improvement in this regard.

Therefore, it is an object of the present invention to provide a fixed contact point practicing machine which can obviate and mitigate the above-mentioned drawbacks.

SUMMARY OF THE INVENTION

The present invention is related to a fixed contact point practicing machine, and more particularly, to a practicing machine for baseball batting.

The primary purpose of the present invention is to provide a fixed contact point practicing machine having a plurality of popping devices, and such popping device can shoot the baseball out from the top for the practice of batting baseball. In addition, its structure is simple, low-price, and definitely can attain the economic and practical effects.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
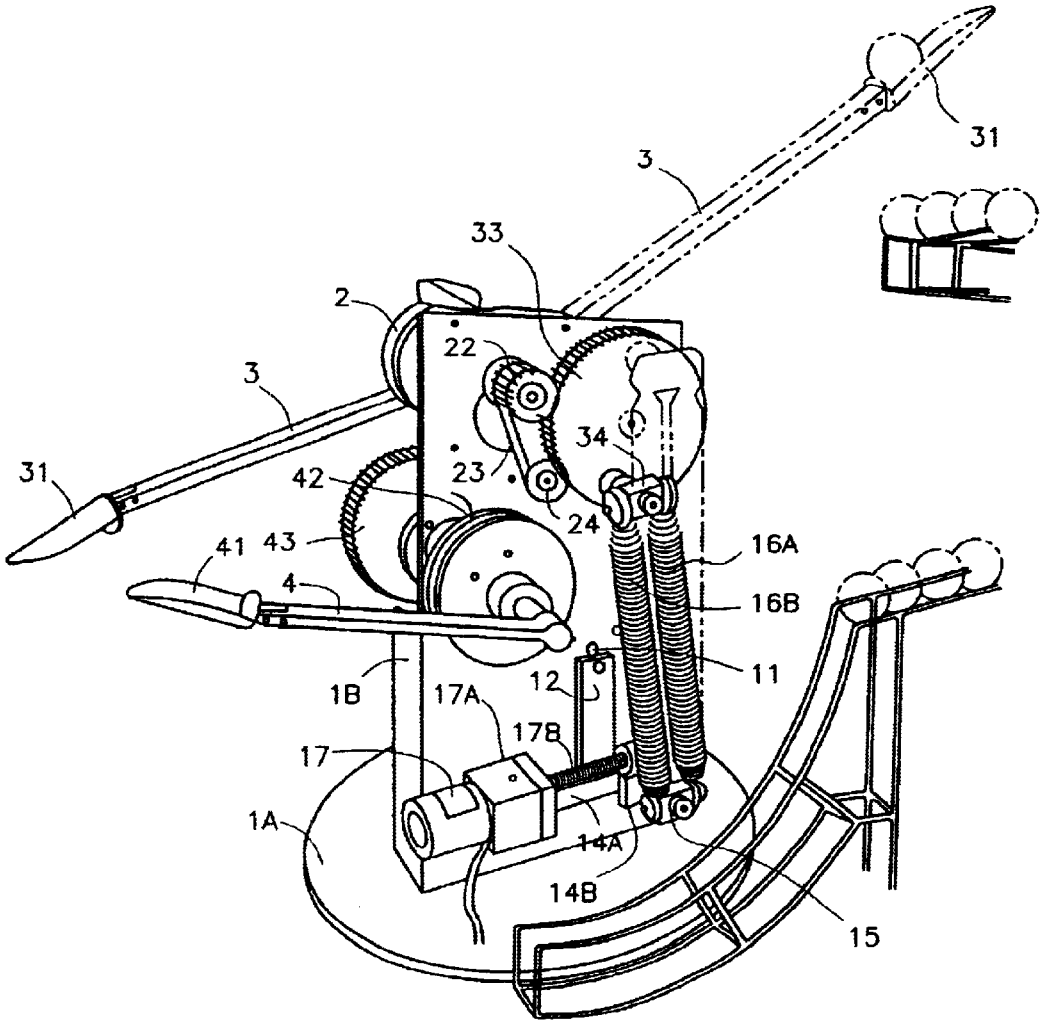
PRIOR ART FIG. 1
FIG. 1 is a three-dimensional diagram of the prior art.
Figure 2:
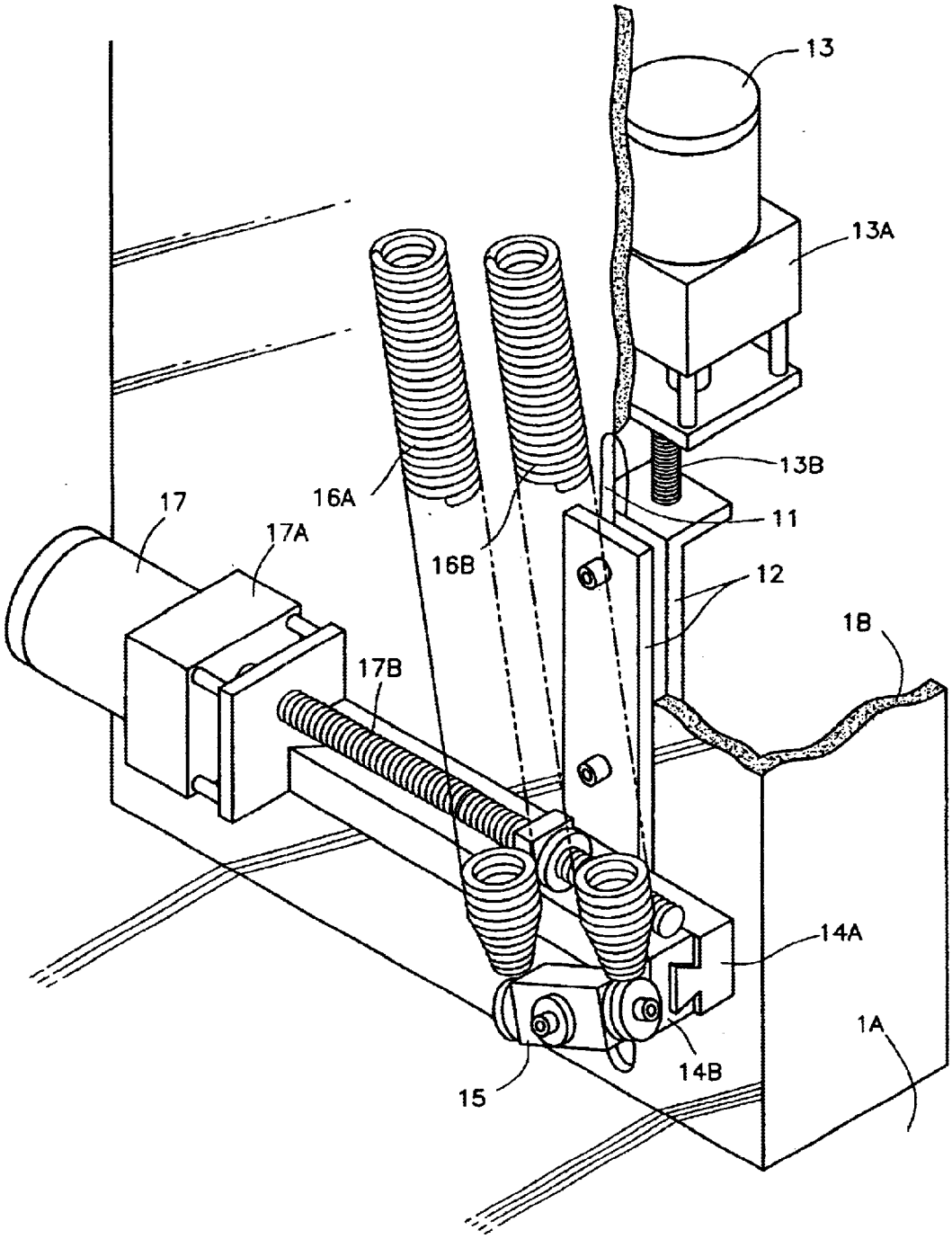
PRIOR ART FIG. 2
FIG. 2 is a three-dimensional diagram of the body of the prior-art machine
Figure 3:
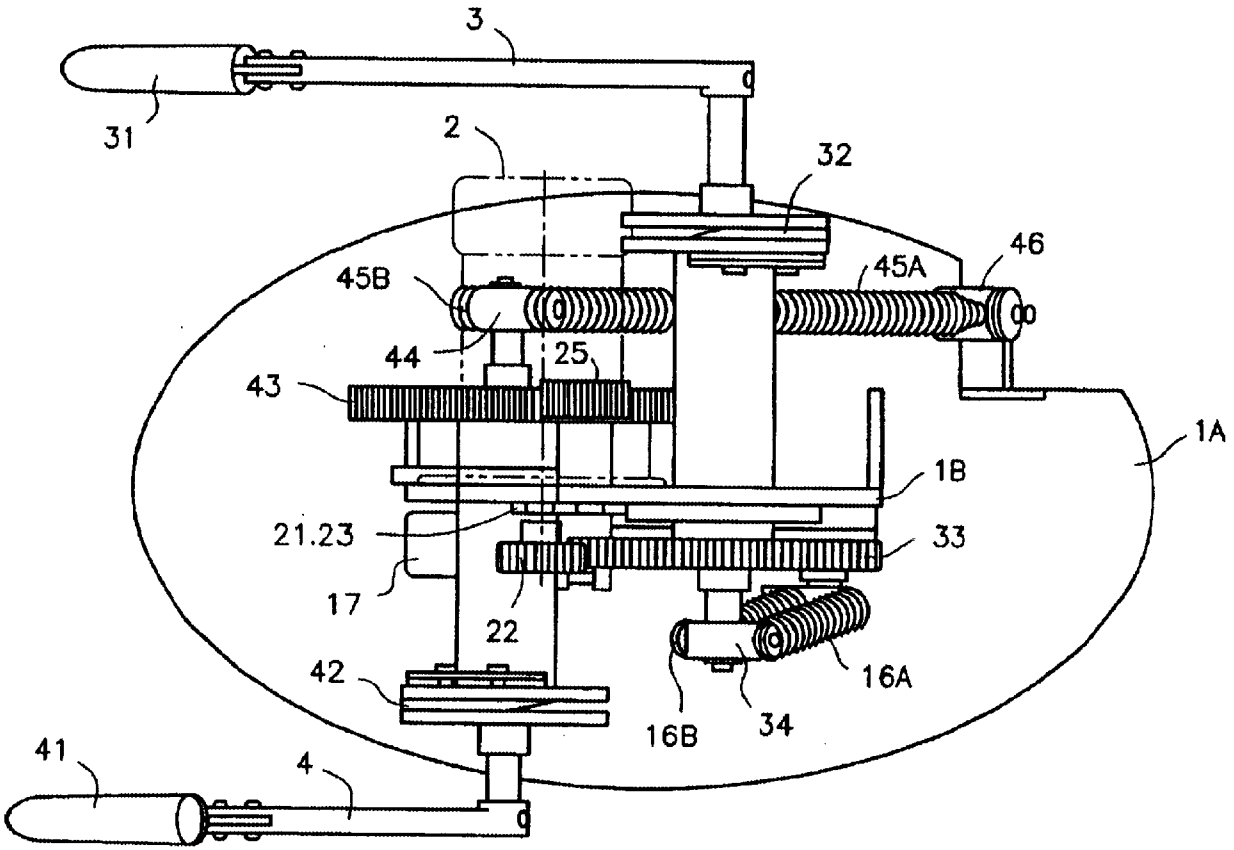
PRIOR ART FIG. 3
FIG. 3 is top view of the prior art.
Figure 4:
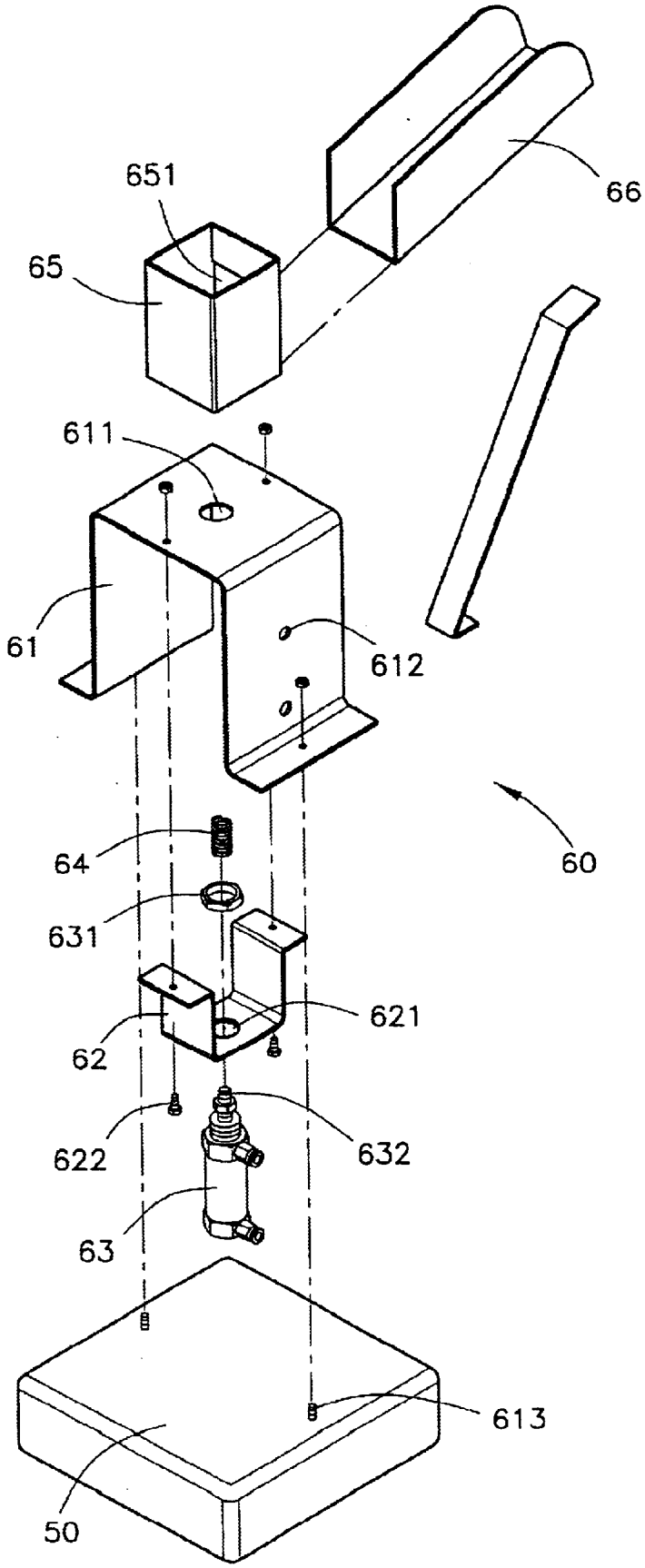
FIG. 4 is a blowup diagram of a preferred embodiment of the present invention.
Figure 5:
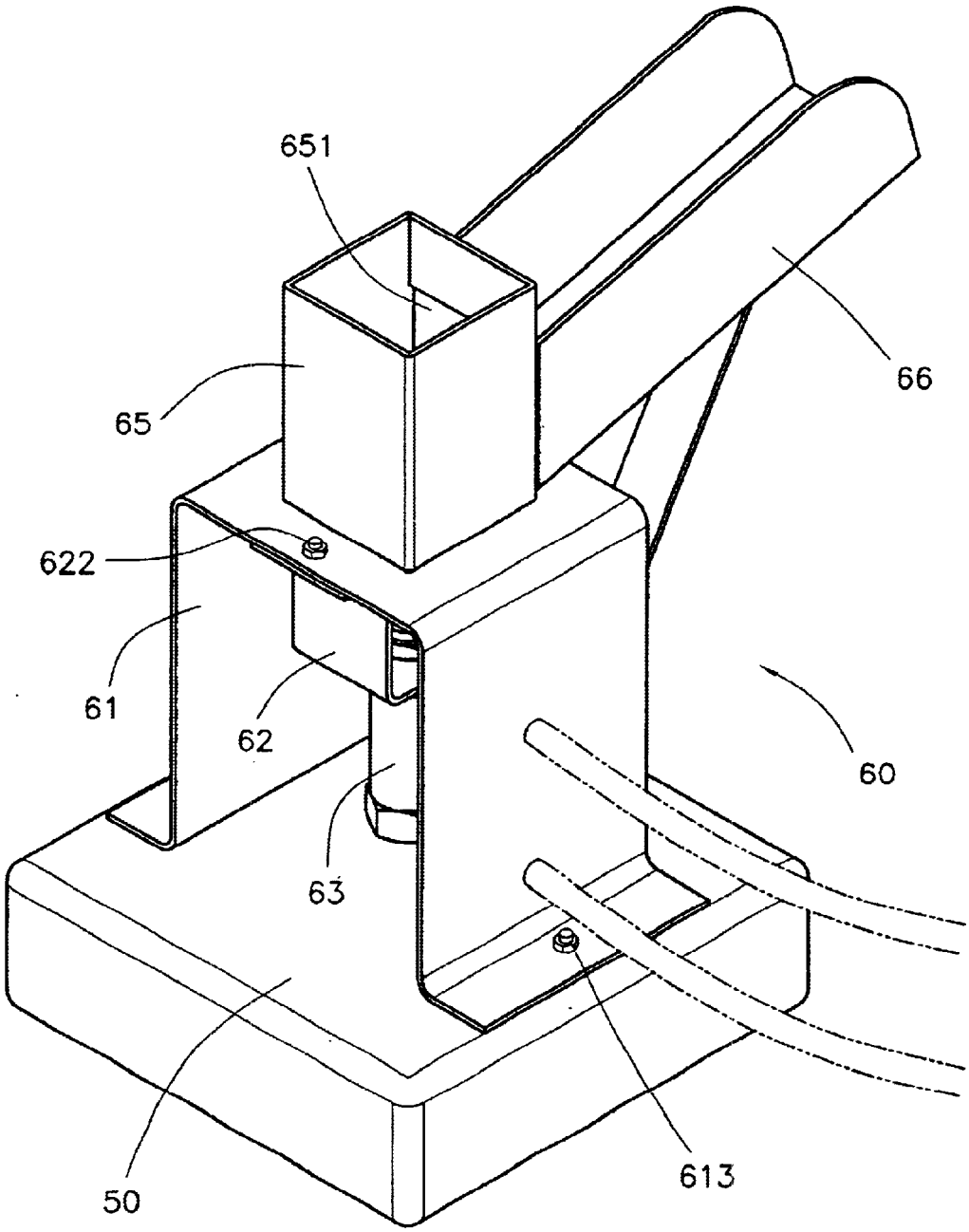
FIG. 5 is a three-dimensional assembled view of the present invention.
Figure 6:
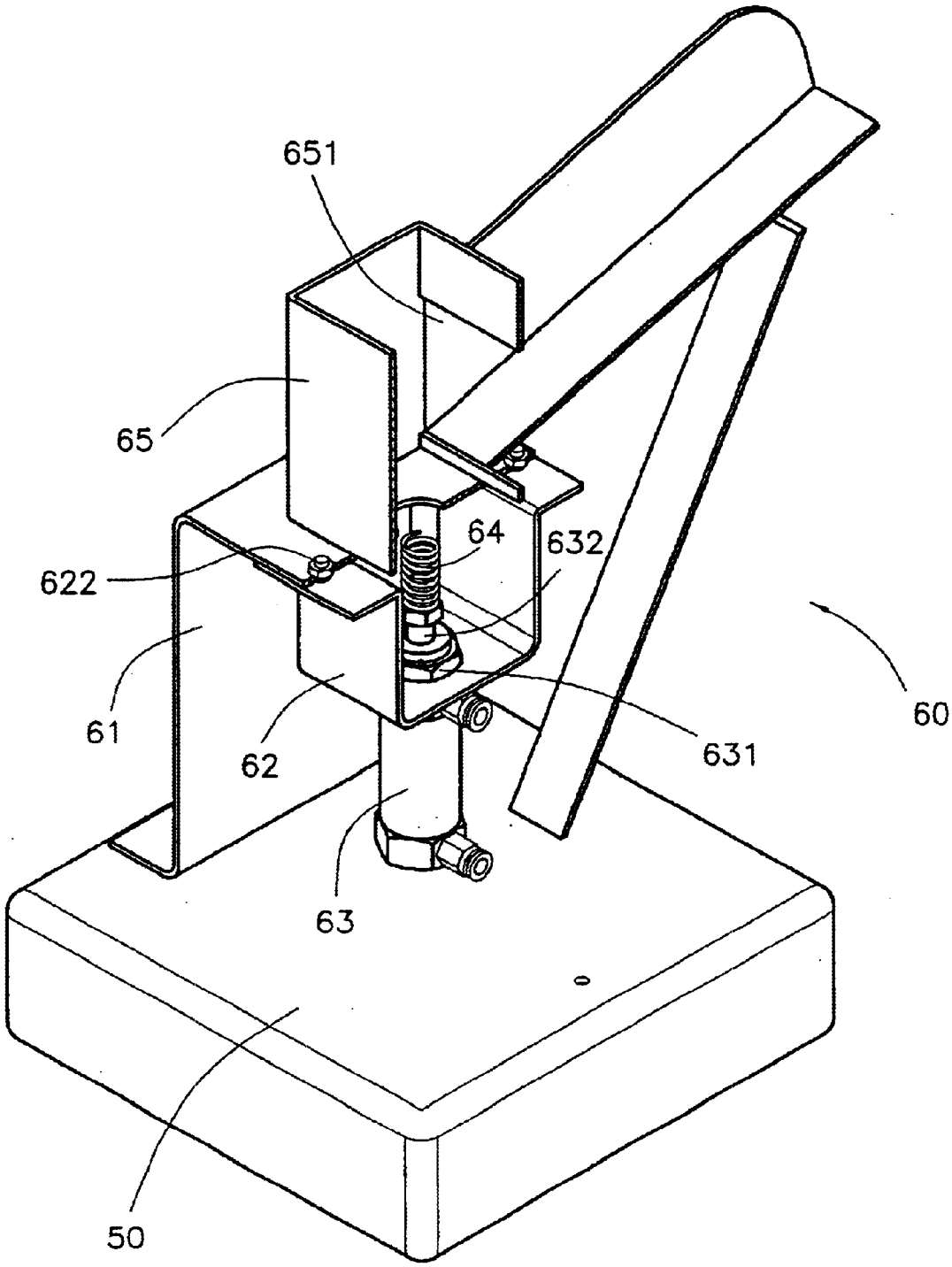
FIG. 6 is a three-dimensional cross-sectional diagram of part of the assembled structure of the present invention.
Figure 7:
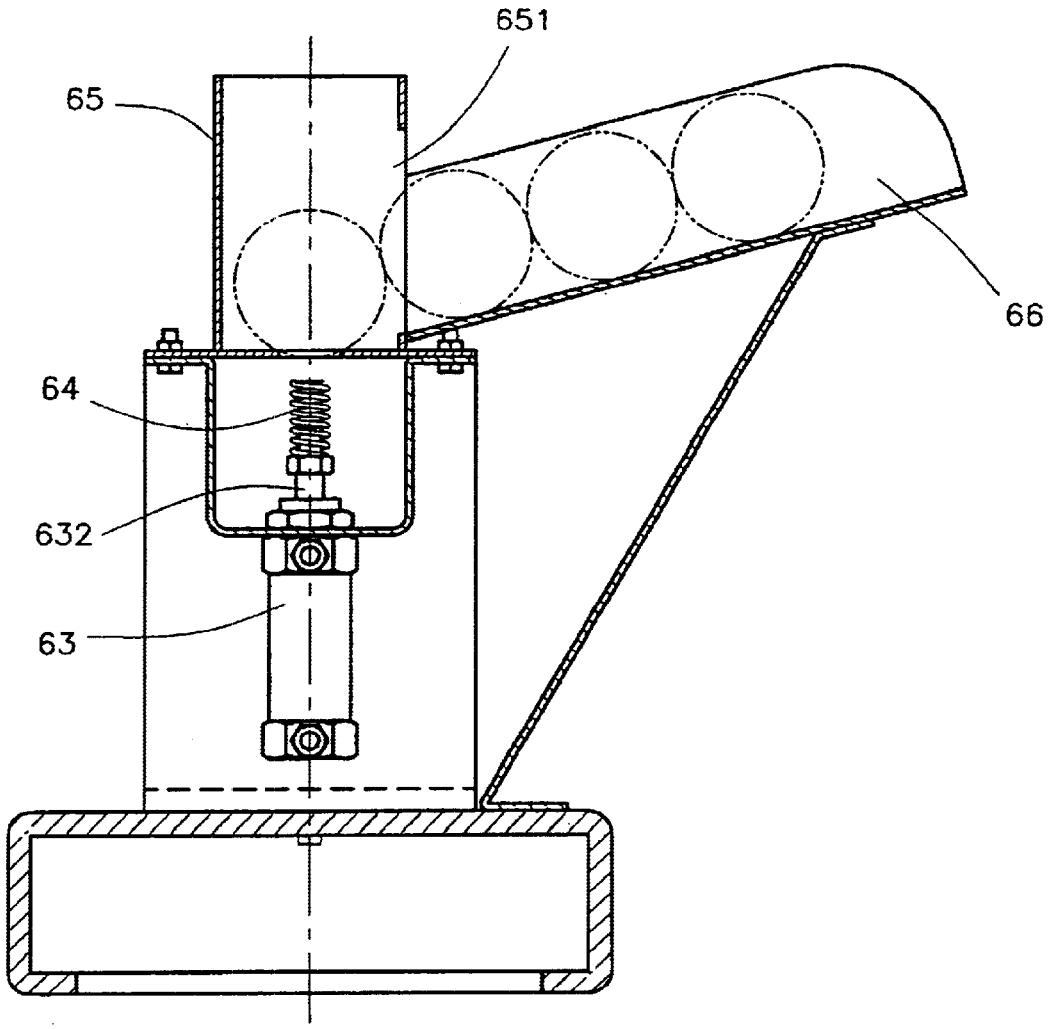
FIG. 7 is a cross-sectional diagram of the present invention.
Figure 8:
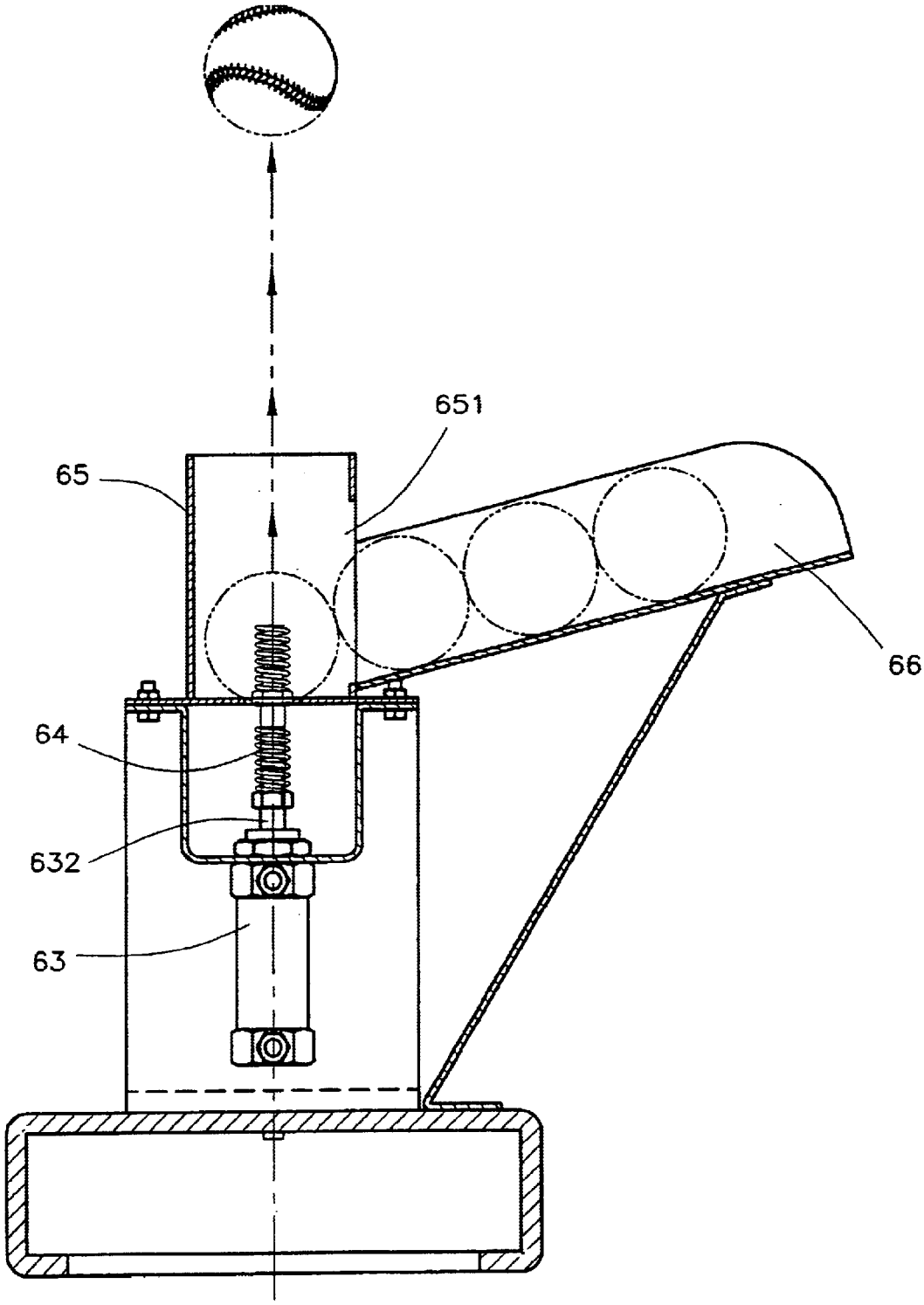
FIG. 8 is a schematic view showing the movement of the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 4 to 7, a preferred embodiment of the present invention comprises a base (50) having a vertical popping device (60) on the base (50), and the popping device (60) further comprises a loading stand (61), a suspending stand (62), a pressure cylinder module (63), a compressed spring (64), an accommodating chamber (65), and a ball guiding track (66); wherein: said loading stand (61) is substantially in the shape of the letter "n", having a penetrating hole (611) at the top, and a through hole (612) on the side, and the whole structure is coupled onto the base (50) by the coupling element (613); said suspending stand (62) is substantially in the shape of a letter "u", having a penetrating hole (621) at the bottom, and being fixed onto the loading stand 61 by another coupling element (622); said pressure cylinder module (63) is fixed onto the suspending stand (62) by screw nut (631) and a contractible axle (632) extending upward into the suspending stand (62) and a compressed spring (64) being installed on the contractible axle (632); said accommodating chamber (65) is a pipe section, being soldered onto the top of the loading stand (61), having a through hole (651) on the side wall of the pipe, such that the position of the through hole (651) is inclined against the ball guiding track (66) and the ball can roll into the accommodating chamber (65) through the through hole (651), and as the contractible axle (632) of the pressure cylinder module (63) spontaneously pops out and in the mean time pushes the compressed spring (64) to shoot out the baseball for the batter's practice.

Figure 9:
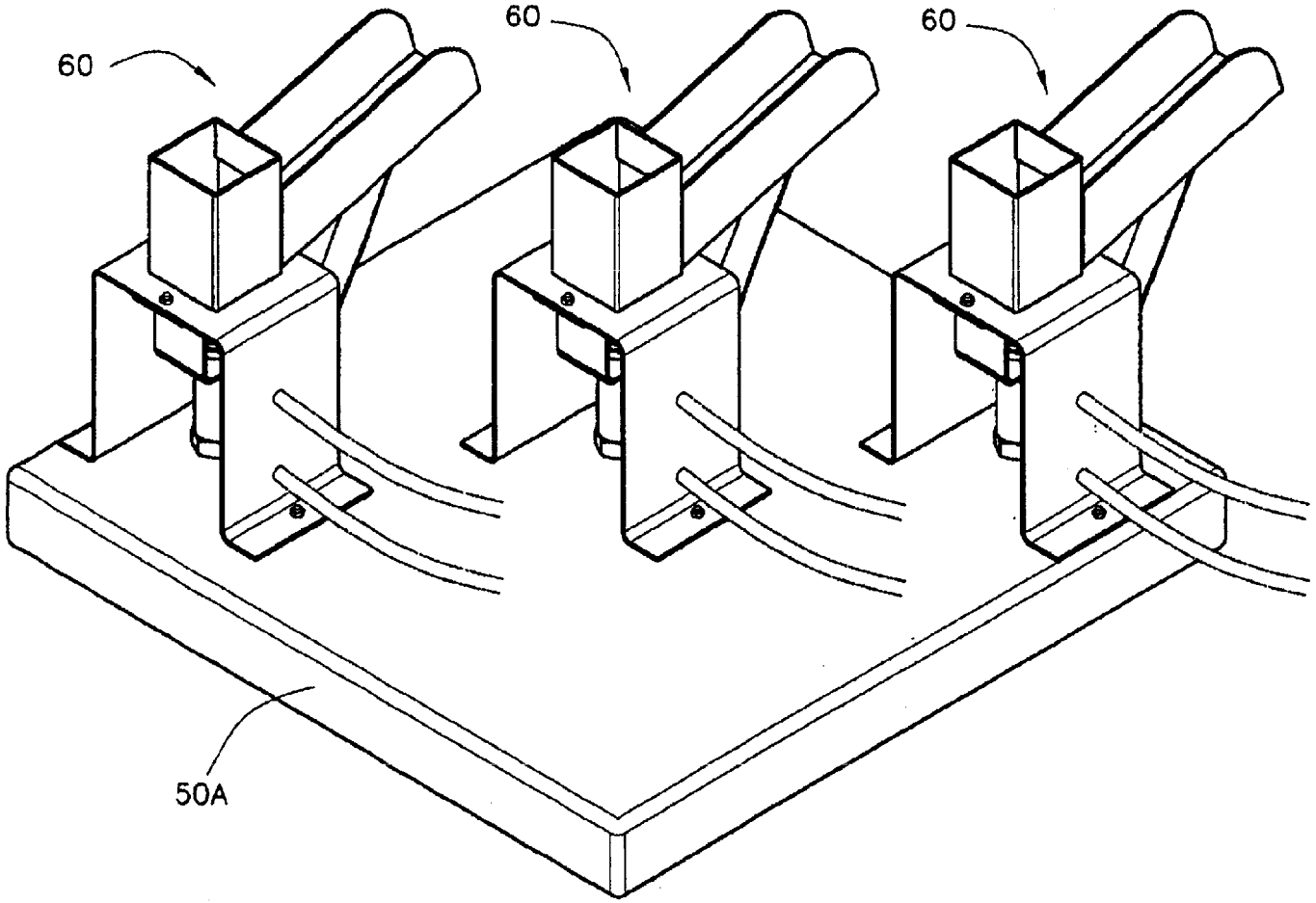
FIG. 9 is a schematic view of another embodiment of the present invention.

Please refer to FIG. 9, which shows a plurality of popping devices (60) on the base (50A) so that they provide the different kinds of inner ball, central ball, and outer ball for the batter's practice.

As to the pressure cylinder module (63) is driven by the compressed air provided by the air compressor and control valve, and it is the prior-art technology, which will not be described here.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A fixed point contact practicing machine, comprising a vertically popping device disposed on a base of the practicing machine; a loading stand, a suspending stand, a pressure cylinder module, a compressed spring, an accommodating chamber, and a ball guiding track characterized in that: said loading stand having a penetrating hole in a top and a through hole in a side of the loading stand; said suspending stand having a penetrating hole at its bottom, being fixed into said loading stand by a coupling element; said pressure cylinder being fixed to the bottom of the suspending stand by a screw nut, and having a contractible axle passing through the penetrating hole of the suspending stand into an interior of the suspending stand, said compressed spring being installed on the contractible axle; the accommodating chamber is fixed vertically onto the top of the loading stand, and a through hole being disposed on a side wall of the accommodating chamber so that an external side of the through hole extends and inclines against the ball guiding track being fixed in position by a propping board; wherein by means of such arrangement, a baseball is placed into the ball guiding track and rolled into the accommodating chamber, and the contractible axle of the pressure cylinder pushes out and pushes the compressed spring to shoot out the baseball from the accommodating chamber to provide practice for baseball batters.

* * * * *